US008863565B2

(12) United States Patent
Tomizawa et al.

(10) Patent No.: US 8,863,565 B2
(45) Date of Patent: Oct. 21, 2014

(54) THREE-DIMENSIONALLY BENDING MACHINE, BENDING-EQUIPMENT LINE, AND BENT PRODUCT

(75) Inventors: Atsushi Tomizawa, Mino (JP); Fumihiko Kikuchi, Tokyo (JP); Shinjiro Kuwayama, Wakayama (JP)

(73) Assignees: Nippon Steel & Sumitomo Metal Corporation, Tokyo (JP); Sumitomo Pipe & Tube Co., Ltd., Ibaraki (JP)

( * ) Notice: Subject to any disclaimer, the term of this patent is extended or adjusted under 35 U.S.C. 154(b) by 851 days.

(21) Appl. No.: 12/718,390

(22) Filed: Mar. 5, 2010

(65) Prior Publication Data

US 2010/0218577 A1 Sep. 2, 2010

(30) Foreign Application Priority Data

Mar. 3, 2005 (JP) ..... 2005-059571
Aug. 24, 2005 (JP) ..... 2005-242441

(51) Int. Cl.
*B21D 37/16* (2006.01)
*B21D 7/16* (2006.01)
*B21D 7/08* (2006.01)

(52) U.S. Cl.
CPC ... *B21D 7/08* (2013.01); *B21D 7/16* (2013.01)
USPC ..... 72/342.6; 72/128; 72/342.1; 72/369

(58) Field of Classification Search
USPC ..... 72/342.6, 177, 342.1, 128, 149, 154, 72/369, 342.5
See application file for complete search history.

(56) References Cited

U.S. PATENT DOCUMENTS

| | | | | | |
|---|---|---|---|---|---|
| 1,891,338 | A | * | 12/1932 | Snell | 72/128 |
| 1,996,838 | A | * | 4/1935 | Snell | 72/128 |
| 2,812,004 | A | * | 11/1957 | Huet | 72/154 |
| 3,229,489 | A | * | 1/1966 | Huet | 72/128 |
| 3,368,377 | A | * | 2/1968 | Hirayama et al. | 72/128 |
| 3,473,361 | A | * | 10/1969 | Cwik | 72/150 |
| 3,956,916 | A | | 5/1976 | Herkner et al. | |
| 4,057,989 | A | | 11/1977 | Takechi et al. | |

(Continued)

FOREIGN PATENT DOCUMENTS

| | | | | | |
|---|---|---|---|---|---|
| DE | 3634672 | | 4/1988 | | |
| JP | 63-5827 | A * | 1/1988 | | B21D 7/08 |
| JP | 06182452 | A * | 7/1994 | | B21D 7/06 |
| JP | 06182454 | A * | 7/1994 | | B21D 7/06 |

*Primary Examiner* — Edward Tolan
(74) *Attorney, Agent, or Firm* — Clark & Brody

(57) ABSTRACT

A three-dimensionally bending machine comprises a supporting unit to support a workpiece and a feeding unit to feed the workpiece from an upstream side of the workpiece. A heating and cooling unit, provided around the outer circumference of a portion of the workpiece downstream of said supporting unit heats the portion of workpiece in a temperature range for plastic deformation and quenches and rapidly cools the deformed workpiece. A three-dimensionally movable unit, provided downstream of said heating and cooling unit, supports the metal material and controls the supporting position and/or the moving speed of the metal material to apply the bending moment in association with a feed amount, a heating amount, and a cooling amount of the workpiece. Even when a high-strength workpiece is bent, a workpiece having excellent shape fixability and uniform hardness distribution can be made, especially for application to sophisticated automobile parts.

15 Claims, 9 Drawing Sheets

(56) References Cited

U.S. PATENT DOCUMENTS

| | | | | |
|---|---|---|---|---|
| 4,061,005 | A | 12/1977 | Kawanami et al. | |
| 4,062,216 | A * | 12/1977 | Hanamoto et al. | 72/128 |
| 4,195,506 | A | 4/1980 | Kawanami et al. | |
| 4,296,919 | A | 10/1981 | Sakurai et al. | |
| 4,596,128 | A | 6/1986 | Ringersma et al. | |
| 5,316,849 | A | 5/1994 | Lu et al. | |
| 5,491,996 | A | 2/1996 | Saarman et al. | |
| 6,097,012 | A | 8/2000 | Shiozuka | |
| 6,477,879 | B1 * | 11/2002 | Sawa | 72/220 |
| 6,626,228 | B1 | 9/2003 | Bewlay et al. | |
| 6,742,374 | B2 | 6/2004 | Ozawa | |
| 6,813,923 | B2 | 11/2004 | Jones et al. | |
| 7,104,100 | B2 * | 9/2006 | Saegusa | 72/149 |
| 7,621,164 | B2 | 11/2009 | Fullerton et al. | |
| 7,748,597 | B2 | 7/2010 | Nicolai et al. | |
| 2002/0170329 | A1 | 11/2002 | Ichiryu et al. | |
| 2003/0038489 | A1 | 2/2003 | Renzzulla et al. | |
| 2004/0216503 | A1 * | 11/2004 | Butscher et al. | 72/295 |
| 2005/0247699 | A1 | 11/2005 | Abbott et al. | |
| 2006/0065035 | A1 * | 3/2006 | Zhang et al. | 72/342.5 |
| 2006/0159376 | A1 | 7/2006 | Takayama et al. | |
| 2006/0200990 | A1 | 9/2006 | Koyama et al. | |
| 2009/0263065 | A1 | 10/2009 | Kobayashi et al. | |
| 2010/0108199 | A1 | 5/2010 | Takayama | |
| 2011/0031779 | A1 | 2/2011 | Uchida et al. | |

* cited by examiner (a)

(b)

(a)

(b)

(a)

(b)

THREE-DIMENSIONALLY BENDING MACHINE, BENDING-EQUIPMENT LINE, AND BENT PRODUCT

This is a continuation-in-part of U.S. application Ser. No. 11/896,319 filed Aug. 31, 2007, which is a continuation of PCT/JP2006/303220 filed Feb. 23, 2006. The PCT application was not in English as published under PCT Article 21(2).

TECHNICAL FIELD

The present invention relates to a bending machine, a bending-equipment line, and more particularly, to a three-dimensionally bending machine and a three-dimensionally bending-equipment line, and to a bent product made by the three-dimensionally bending machine or the three-dimensionally bending-equipment line.

BACKGROUND ART

In recent years, demands for structural metal materials having high strength and light weight have increased in consideration of global environment. For example, in an automobile industry, there are growing demands for the safety of car body, and high-strength and light-weight parts of an automobile are increasingly required, so that parts of an automobile have been developed in order to improve fuel efficiency and collision safety.

In order to meet these demands, a high strength steel sheet having a much higher tensile strength than that in the prior art, for example, a material having high strength with a tensile strength of 780 MPa or more, preferably, 900 MPa or more, has come into widespread use.

Meanwhile, while improving the strength of the steel sheet, the conventional structures of parts of an automobile have been reexamined. Following the above, there is a strong demand for the development of an art for accurately bending a metal material in any of various shapes, such as an art for two-dimensionally or three-dimensionally bending a metal material in different directions, in order to apply to various types of parts of an automobile.

In order to meet the demands for the development of the bending technology, various processing techniques have been proposed. For example, Japanese Patent Application Publication No. 50-59263 and Japanese Patent No. 2816000 disclose a method for bending a metal tube or the like while performing a thermal treatment on the metal tube or the like. Specifically, the following methods are disclosed: a bending method for clamping a leading end of a metal tube or the like with a rotatable arm, heating the metal tube or the like by using a heating unit, appropriately moving the heated portion of the metal tube or the like to bend the heated portion, and cooling down the bent portion (Japanese Patent Application Publication No. 50-59263); and a method for applying torsional and bending force to the heated portion of the metal tube or the like to bend the metal tube or the like while twisting the metal tube or the like (Japanese Patent No. 2816000).

However, the disclosed bending methods are so-called grab bending methods requiring a rotatable arm for clamping the leading end of a metal tube or the like, which makes it difficult to feed the metal tube or the like to be bent at high speed. In addition, the arm needs to make a return movement in order to repeatedly clamp the metal tube or the like, resulting in a significant variation in the feeding speed of the metal tube or the like. Therefore, a complicated control is required for a heating or cooling speed, which makes it difficult to ensure predetermined quenching accuracy.

In order to solve the above-mentioned problems of the grab bending method, Japanese Patent Application Publication No. 2000-158048 discloses a high-frequency heating bender based on push bending that supports a push bending roller so as to be movable in a three-dimensional direction. According to the high-frequency heating bender disclosed in Japanese Patent Application Publication No. 2000-158048, the push bending roller is swung around a workpiece toward the opposite side of the workpiece, and comes into contact with the opposite side of the workpiece, thereby bending the workpiece. Therefore, in a two-dimensional continuous bending operation in which a workpiece is two-dimensionally bent in different directions in, for example, an S shape, a procedure of turning the workpiece by 180 degrees is not needed.

However, in the high-frequency heating bender disclosed in Japanese Patent Application Publication No. 2000-158048, since there is no resort to clamp both side-faces of a workpiece to be bent is not provided, the workpiece is likely to be deviated from the intended shape due to the residual stress caused by a cooling operation after the high-frequency heating. Therefore, it is difficult to ensure predetermined dimensional accuracy, which makes it difficult to improve the accuracy of bending, while restricting the processing speed of the workpiece.

Further, Japanese Patent No. 3195083 discloses a push-through bending machine that includes, instead of the push bending roller of the high-frequency heating bender or the grab bending method, a fixed die, a movable gyro die that is movable in a three-dimensional direction, and a heating unit that heats a metal member at a temperature according to the curvature of the metal member to be formed by the movable gyro die.

In the bending machine disclosed in Japanese Patent No. 3195083, since either the movable gyro die or the fixed die does not rotatably support a metal member to be bent, the surface thereof is susceptible to seizure defects. In the bending machine disclosed in Japanese Patent No. 3195083, a cooling fluid is supplied to either the movable gyro die or the fixed die to prevent the decrease in strength of dies and the deterioration of bending accuracy due to their thermal expansion. However, Japanese Patent No. 3195083 is not directed to perform a thermal treatment, such as quenching, on the bent metal member, and thus it is difficult to obtain a metal member having high strength.

DISCLOSURE OF THE INVENTION

As described above, a technique for bending a metal material in various bending shapes to be applied to various parts of an automobile is demanded in association with reassessing the structures of the parts of an automobile. Meanwhile, it is desirable that the metal material have a tensile strength of 900 MPa or more, preferably, 1300 MPa or more, in order to reduce the weight of the metal material. In this case, a metal tube having a tensile strength of about 500 to 700 MPa is bent as a starting material and a thermal treatment is performed on the bent metal tube to improve the strength of the metal tube, thereby obtaining a metal material having high strength.

However, in the grab bending method disclosed in Japanese Patent Application Publication No. 50-59263 and Japanese Patent No. 2816000, since the feeding speed of the metal tube varies significantly, the cooling speed cannot be accurately controlled, and a high degree of quenching accuracy cannot be ensured, which makes it difficult to prevent the occurrence of uneven distortion. As a result, variations in shape occur in for the bent metal material, and delayed fracture occurs in the metal material having high strength due to the residual stress. Thus, products made by the grab bending method are not suitable for parts of an automobile.

Further, the bending machine disclosed in Japanese Patent No. 3195083 is based on push-through bending, but is not directed to obtain a metal material having high strength by performing hot working on a metal tube having low strength as a starting material and then performing quenching on the heated metal tube to increase the strength of the metal tube. In addition, the surface of the movable gyro die is susceptible to seizure defects on due to the heating of the metal tube. Therefore, the hot bending machine needs to be further improved.

The invention is designed to solve the above-mentioned problems, and it is an object of the present invention to provide a bending machine and a bending equipment line to bend a metal material with a high degree of operation efficiency, while the method allowing a high degree of bending accuracy to be ensured even when a metal material is bent in various shapes in association with diversification of structures of automobile parts and further even when a metal material having high strength is bent likewise.

In order to achieve the object, according to an aspect of the present invention, there is provided a three-dimensionally bending machine comprising: a supporting unit for supporting a metal material as a workpiece; a feeding unit for successively or continuously feeding the workpiece from an upstream side of the workpiece; a heating and cooling unit that is provided around the outer circumference of a portion of the workpiece and at a downstream side of said supporting unit, for use in heating a portion of workpiece in a temperature range which allows the heated portion of the workpiece to be plastically deformed and which allows quenching to be performed, and for use in subsequently rapidly cooling down the heated portion of the workpiece after a bending moment is applied thereto; and a three-dimensionally movable unit that is provided at the downstream side of said heating and cooling unit, for use in clamping the workpiece and controlling the supporting position and/or the moving speed of the workpiece to apply the bending moment in association with a feed amount of the workpiece by said feeding unit and a heating amount and a cooling amount of the workpiece by said heating and cooling unit.

That is, in the bending of a metal material as a workpiece, the downstream side of the workpiece is supported, and a thermal treatment is performed on the the workpiece while moving the workpiece at a predetermined speed, which makes it possible to ensure a predetermined cooling speed. In addition, since the bent workpiece is uniformly cooled down, it is possible to obtain a product having excellent shape fixability despite high strength, and uniform hardness.

For example, specifically, a blank tube of metal material as a workpiece is successively and continuously heated by a high-frequency heating coil at an $A_3$ transformation point or more and up to a temperature at which coarse grains are not generated, and the locally heated portion of the workpiece is plastically deformed by movable roller-dies. Then, a cooling medium having water or oil as the main ingredient or other cooling fluids, or otherwise, gas or mist is injected onto the outside surface or both the outside and inside surface of the in-process tube, thereby enabling to ensure a cooling speed of 100° C./sec or more.

In addition, the three-dimensionally movable unit functioned to apply a bending moment clamps the workpiece in a rolling manner to prevent seizure defects on the surface of dies, which makes it possible to effectively bend the workpiece. Similarly, since the supporting unit rotatably supports the workpiece, it is possible to prevent seizure defects on the surface of the supporting unit.

According to a second aspect of the present invention, preferably, the three-dimensionally movable unit includes at least one of a shifting mechanism for moving the three-dimensionally movable unit in a vertical direction, the one for moving the same in a horizontal direction, a tilting mechanism for inclining the same in a vertical plane, and the one for inclining the same in a horizontal plane. According to this structure, even when the workpiece is bent in various shapes, such as in a two-dimensional continuous bending operation (for example, an S-shaped bending operation) in which the workpiece is two-dimensionally bent in different directions or a three-dimensional continuous bending operation in which the workpiece is three-dimensionally bent in different directions, it is possible to effectively perform bending.

According to a third aspect of the present invention, preferably, the three-dimensionally movable unit further includes a moving mechanism for moving itself in the forward or backward direction relative to the workpiece. According to this structure, even when the bending radius of a metal product is small, it is possible to ensure an appropriate arm length L, which makes it possible to prevent an increase in the scale of a bending machine and ensure a high degree of bending accuracy.

According to a fourth aspect of the present invention, preferably, the heating and cooling unit include at least one of a shifting mechanism for moving itself in a vertical direction, the one for moving the same in a horizontal direction, a tilting mechanism for inclining the same in a vertical plane, and the one for inclining the same in a horizontal plane. According to this structure, it is possible to synchronize the operation of the three-dimensionally movable unit with that of the heating and cooling unit, which makes it possible to perform much more accurate and uniform bending.

According to a fifth aspect of the present invention, preferably, the heating and cooling unit further include a moving mechanism for moving the unit in the forward or backward direction relative to the workpiece. According to this structure, it is possible to heat the leading end of a metal tube at the beginning of a bending operation, in addition to synchronization between the operation of the three-dimensionally movable unit and that of the heating and cooling unit. Therefore, it is possible to improve workability and operability when mounting or dismounting a metal tube.

According to a sixth aspect of the present invention, preferably, the three-dimensionally movable unit includes a rotating mechanism for rotating itself in a circumferential direction. According to this structure, it is possible to twist the workpiece, in addition to two-dimensionally or three-dimensionally bending the workpiece in different directions.

According to a seventh aspect of the present invention, preferably, a feeding unit provided at the upstream side of the workpiece may include a mechanism that holds and rotates a workpiece in a circumferential direction. According to this structure, it is possible to twist the workpiece, in addition to two-dimensionally or three-dimensionally bending the workpiece in different directions, without using the rotating mechanism of the three-dimensionally movable unit.

According to an eighth aspect of the present invention, preferably, the supporting unit includes a rotating mechanism for rotating itself in a circumferential direction in synchronization with the rotation of the feeding unit. According to this structure, for a torsional deformation of the workpiece, the rotating mechanism of the feeding unit twists a rear end of the workpiece, while synchronizing with the operation of the supporting unit, without rotating the three-dimensionally movable unit in a circumferential direction, which makes it possible to accurately twist the workpiece. Alternatively, the rotating mechanism of the feeding unit may perform the relative twisting of the rear end of the workpiece in synchronization with the operation of the supporting unit, while independently rotating the three-dimensionally movable unit in a circumferential direction. In this case, it is also possible to accurately twist the workpiece.

According to a ninth aspect of the present invention, preferably, the three-dimensionally movable unit includes a driving and rolling mechanism that drives rolls as roller-dies, such as a driving motor that drives and rotates the rolls according to the feed amount of the workpiece by the feeding unit. That is, if the three-dimensionally movable unit should not include the driving and rolling mechanism, the rolls are driven by only frictional resistance, and compressive stress is applied to the bent portion of the workpiece, so that thickness of the inner radius side of the bent portion increases, resulting in buckling. In particular, when a thin workpiece is used, the buckling makes it difficult to bend the thin workpiece, or may otherwise cause the accuracy of bending to be deteriorated.

In contrast, the driving and rolling mechanism provided in the three-dimensionally movable unit reduces the compressive stress applied to the bent portion. In addition, when the revolving speed of the roller-dies of the three-dimensionally movable unit is controlled so as to be synchronized with the feed amount of the workpiece fed through by the feeding unit, it is possible to apply tensile stress to the bent portion and thus widen the available range for bending. As a result, it is possible to improve the bending accuracy of a workpiece.

According to a tenth aspect of the present invention, preferably, the three-dimensionally movable unit may comprise two roller-dies, three roller-dies, or four roller-dies.

According to an eleventh aspect of the present invention, preferably, the workpiece subjected to a bending operation is a closed cross-section member, an open cross-section member, an irregular cross-section member, or a rod member, wherein the cross-section thereof is formed in various shapes. According to this configuration, it is possible to design the roll caliber for the three-dimensionally movable unit according to the cross-section of a workpiece to be bent.

According to a twelfth aspect of the present invention, preferably, one or more preheating units are provided at the upstream side of the heating and cooling unit to perform two-stage heating or preferential heating on the workpiece. According to this aspect, when a preheating unit for plural-stage heating is used, it is possible to disperse the heating load on the workpiece, thus enabling to improve bending efficiency.

Meanwhile, when a preheating unit for preferential heating is used, the temperature of the heated portion of the workpiece intended to be an inner radius side of the bend is controlled to be lower than that of the heated portion intended to be an outer radius side of the bend, taking into account the bending direction of the workpiece opted by the three-dimensionally movable unit. When the heated portion of the workpiece is configured in this way, it is possible to prevent wrinkles from being generated on the inner radius surface of the bent portion and cracks from being generated in the outer radius surface of the bent portion.

According to a thirteenth aspect of the present invention, preferably, a mandrel, serving as the cooling means, is inserted into the inside of the workpiece, and a cooling medium is supplied by the mandrel alone and/or in combination with the cooling unit provided around the outer circumference of the workpiece. According to this feature, it is possible to ensure the cooling rate for, particularly, a thick-wall workpiece.

According to a fourteenth aspect of the present invention, preferably, an articulated robot having one or more joints is provided, the joint each being able to rotate on its own axis respectively, and the articulated robot performs the operation of at least one of the shifting mechanism, the tilting mechanism, and the moving mechanism of the three-dimensionally movable unit, and the heating and/or cooling unit.

According to this feature, during the bending of a workpiece, the articulated robot can perform on the basis of control signals, a series of operations, each of which is effected by a manipulator, such as a shifting operation in a vertical or horizontal direction, a tilting operation in a vertical or horizontal plane, and a moving operation in the forward or backward direction, all of which are supposed to be carried out by the three-dimensionally movable unit, the heating and cooling unit respectively. Therefore, it is possible to improve the efficiency of a bending operation and reduce the size of a bending machine.

According to the present invention, in order to effectively produce an inexpensive bent product from a round tube supplied as a workpiece, a three dimensional-bending-equipment line includes: an electric resistance welded steel tube production line that includes: an uncoiler that continuously unrolls into a strip-shaped steel sheet; a forming means that forms the unrolled strip-shaped steel sheet into a steel tube having a predetermined shape in a sectional view; a welding means that welds opposite side edges of the strip-shaped steel sheets to form continuous tubular goods; and a post-processing means that performs a weld bead cutting operation, and, if necessary, a post-annealing operation or a sizing operation; and the three-dimensionally bending machine according to the above-mentioned aspect that is sequentially disposed at the exit side of said electric resistance welded steel tube manufacturing line.

According to the present invention, in order to effectively produce an inexpensive bent product from an open cross-section material supplied as a workpiece, a three-dimensional-bending-equipment line includes: a roll forming line that includes: an uncoiler that continuously unrolls into a strip-shaped steel sheet; and a forming means that forms the unrolled strip-shaped steel sheet into having a predetermined shape in a sectional view; and the three-dimensionally bending machine according to the above-mentioned aspect that is sequentially disposed at the exit side of said roll forming line.

Further, a bent product of the invention is characterized in that the product having a tensile strength of 900 MPa or more is made by virtue of a thermomechanical treatment subjected during the course when the bending machine as above is used.

According to the three-dimensionally bending machine, and the three-dimensional-bending-equipment line in accordance with the above-described aspects of the present invention, even when a workpiece is bent in various shapes, such as in a two-dimensional continuous bending operation in which the workpiece is two-dimensionally bent in different directions (for example, an S shape) or in a three-dimensional continuous bending operation in which the workpiece is three-dimensionally bent in different directions, and even when a workpiece having high strength is bent, the workpiece is uniformly cooled down, whereby it is possible to effectively obtain a metal product having excellent shape fixability despite having high strength, and uniform hardness distribution at a low cost.

Further, since the three-dimensionally movable unit rotatably clamps a workpiece, it is possible to retard the generation of seizure defects on the surface of roller-dies in the three-dimensionally movable unit. Therefore, the accuracy of a bending operation can be ensured, and a bending operation can be performed with a high degree of operation efficiency.

BRIEF DESCRIPTION OF THE DRAWINGS

FIG. 2A shows a channel with an open cross section that is made by roll forming, and FIG. 2B shows a channel with an irregular cross-section that is made by an extrusion process.

FIG. 3A shows the cross-sectional structure of the supporting unit and a rotational mechanism provided in the supporting unit, and FIG. 3B is a perspective view illustrating the general appearance of the supporting unit.

BEST MODE FOR CARRYING OUT THE INVENTION

Hereinafter, the overall configuration of a three-dimensionally bending machine, an example structure of a supporting unit, the structure of a feeding unit, an example structure of a heating and cooling unit, the structure of a three-dimensionally movable unit, the feature and operation of a preheating unit, the structure and layout of an articulated robot, and the characteristics of a three-dimensional-bending-equipment line according to exemplary embodiments of the present invention will be described with reference to the accompanying drawings.

Figure 1:
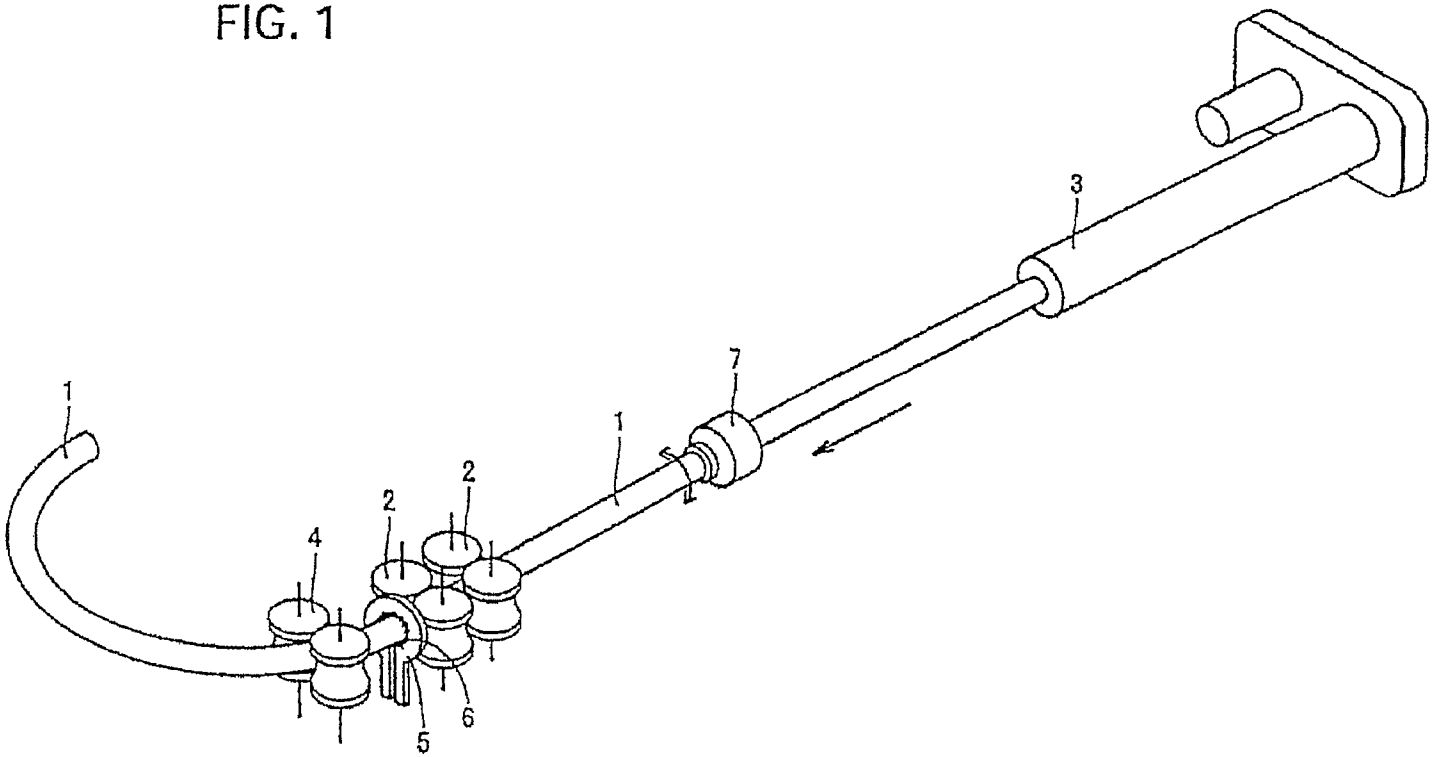
FIG. 1 is a diagram illustrating the overall structure of a three-dimensionally bending machine for performing a bending operation according to the present invention.

1. Overall Structure of Three-Dimensionally Bending Machine and Example of Structure of Supporting Unit FIG. 1 is a diagram illustrating the overall structure of a three-dimensionally bending machine for performing a bending operation according to the present invention. In the bending method, a workpiece 1 as a starting material that is rotatably supported by a supporting unit 2, is successively or continuously fed from an upstream side, and is then bent at a downstream side of the supporting unit 2.

The workpiece 1 made by metal material such as an alloy shown in FIG. 1 has a circular shape (round tube) in a sectional view, but the present invention is not limited thereto. Workpieces having various shapes in a sectional view may be used. For example, the following materials may be used as the workpiece 1; materials with a closed cross section that have various shapes in a sectional view including the circular shape (round tube) shown in FIG. 1, a rectangular shape, a trapezoidal shape, and other complicated shapes; materials (channels) with an open cross section that are manufactured by, for example, roll forming; materials (channels) with an irregular cross section that are produced by an extrusion process; and rod-shaped materials having various shapes in sectional view (a circular rod, a rectangular rod, and an irregular-shape rod).

Figure 2:
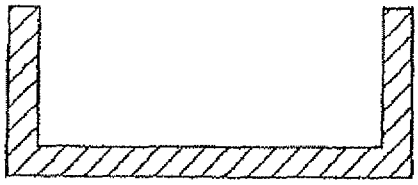
FIGS. 2A and 2B are diagrams illustrating the cross-sectional shapes of a workpiece that can be used as a starting material according to the present invention. Specifically.
Figure 2:
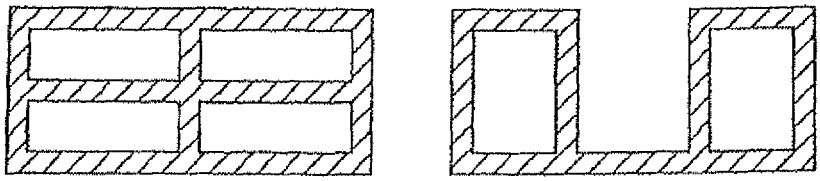

FIGS. 2(*a*) and 2(*b*) are diagrams illustrating the cross-sectional shapes of workpieces that can be used as the starting materials according to the present invention. Specifically, FIG. 2(*a*) shows a channel with an open cross section that is manufactured by, for example, roll forming, and FIG. 2(*b*) shows channels with an irregular cross section that are produced by extruding. In the three-dimensionally bending machine according to the present invention, it is necessary to design the shape of the three-dimensionally movable unit or the supporting unit according to the cross-sectional shape of the workpiece to be used.

The structure of the three-dimensionally bending machine shown in FIG. 1 includes: two pairs of supporting units 2 for rotatably supporting the workpiece 1; a feeding unit 3 that is provided at the upstream side of the supporting unit 2 and successively or continuously feeds the workpiece 1; and a three-dimensionally movable unit 4 that is provided at the downstream side of the two pairs of supporting unit 2, clamps the workpiece 1, and controls the supporting position of the workpiece 1 and/or the moving speed thereof. The structure of the three-dimensionally bending machine further includes: a high-frequency induction heating coil 5 that is provided around the outer circumference of the workpiece 1 on the entrance side of the three-dimensionally movable unit 4, and locally heats a portion of the workpiece 1; and a cooling unit 6 that rapidly cools down the heated portion of the workpiece 1 to which bending moment is applied.

In the three-dimensionally bending machine shown in FIG. 1, since the workpiece having a circular shape (round tube) in a sectional view is used, supporting rolls are used as the supporting unit 2, but the present invention is not limited thereto. For example, a supporting guide may be used according to the cross-sectional shape of a workpiece used. In addition, as shown in FIG. 1, two pairs of supporting rollers are used, but the number of supporting rolls is not limited to two. For example, plural pairs more than one or two pairs of supporting rollers may be used.

Figure 3:
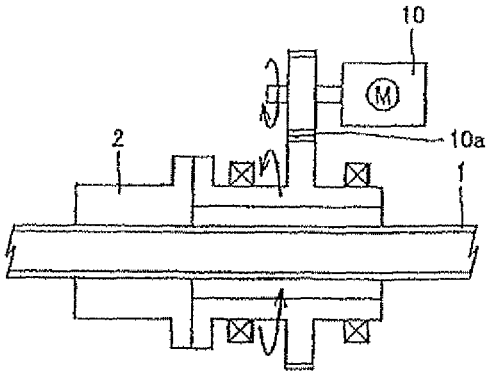
FIGS. 3A and 3B are diagrams illustrating examples of the structure of a supporting guide that can be used as a supporting unit according to the present invention. Specifically.
Figure 3:
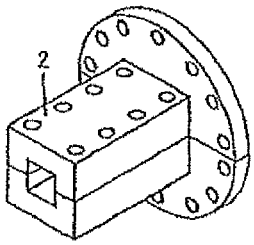

FIGS. 3(*a*) and 3(*b*) are diagrams illustrating examples of the structure of a supporting guide that can be used as the supporting unit according to the present invention. Specifically, FIG. 3(*a*) shows the cross-sectional structure of the supporting guide and a rotating mechanism provided in the supporting guide, and FIG. 3(*b*) is a perspective view illustrating the general appearance of the supporting guide 2. The supporting guide 2 shown in FIG. 3 rotatively supports a rectangular tube 1, which is a workpiece, and includes means for preventing the heating of the supporting guide that is disposed close to the heating and cooling unit (the high-frequency induction heating coil 5 shown in FIG. 1). As means for preventing the heating of the supporting guide, it is preferably to construct it using a non-magnetic material. In addition, as shown in FIG. 3(*b*), the means for preventing the heating of the supporting guide may be divided into two or more segments, and attaching an insulating material, such as Teflon, to the divided segments is effective to prevent the supporting guide from being heated.

A rotating mechanism including a driving motor 10 and a rotational gear 10*a* is directly connected to the supporting guide 2 such that the supporting guide 2 can be rotated in a circumferential direction in synchronization with the rotation of the feeding unit, which will be described in detail below. Therefore, when the workpiece 1 is to be twisted, it is possible to accurately deform the workpiece 1.

In the three-dimensionally bending machine according to the present invention, the supporting rolls shown in FIG. 1 or the supporting guide shown in FIG. 3 can be used as the supporting unit for the workpiece 1. However, for the purpose of the consistency of explanation, in the following a mode and an effect will be shown in the case where a round tube is used as the workpiece, and the supporting rolls are used as the supporting unit. In the present invention, it goes without saying that, even when a rod-shaped material or a material with a closed cross section, an open cross section, or an irregular cross section is used instead of the round tube, or even when the supporting guide is used as the workpiece instead of the supporting rolls, the exactly same effect as described above can be obtained.

2. Structure of Processing Section and Structure of Each of Heating and Cooling Unit.

Figure 4:
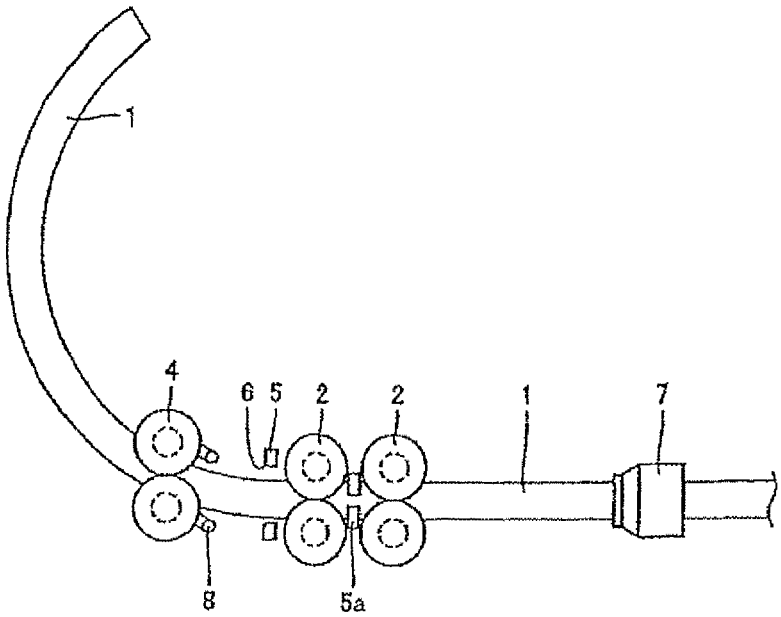
FIG. 4 is a diagram illustrating the structure of a main part of the three-dimensionally bending machine according to the present invention.

FIG. 4 is a diagram illustrating the structure of a processing core section of the three-dimensionally bending machine according to the present invention. The two pairs of supporting rolls 2 for supporting the workpiece 1 are provided, and the three-dimensionally movable unit 4 is arranged at the downstream side of the supporting rolls 2. In addition, the high-frequency induction heating coil 5 and the cooling device 6 are arranged on the entrance side of the three-dimensionally movable unit 4. Further, a preheating unit 5*a* is provided between the two pairs of supporting rolls 2, and a lubrication unit 8 for supplying a lubricant is provided in close proximity to the entrance of the three-dimensionally movable unit 4.

In the structure of the three-dimensionally bending machine shown in FIG. 4, the three-dimensionally movable unit 4 clamps workpiece 1 passing through the two pairs of supporting rolls 2, and controls the supporting position and/or the moving speed thereof. Then, the high-frequency induction heating coil 5 provided around the outer circumference of the workpiece 1 locally heats and bend a portion of the workpiece 1, followed by a subsequent rapid cooling by means of the cooling device 6 provided around the outer circumference of workpiece 1. During the bending operation, since the high-frequency induction heating coil 5 heats workpiece 1 that passes through the supporting rolls 2, the yield strength of the portion of workpiece 1 to be bent by the three-dimensionally movable unit 4 becomes low, and deformation resistance is lowered, which makes it easy to bend the workpiece 1.

Furthermore, since the three-dimensionally movable unit 4 clamps workpiece 1 using movable rolls as roller-dies, it is possible to retard the generation of seizure defects on the surfaces of rolls despite clamping is done right after heating workpiece 1. In addition, the lubricant is supplied to the three-dimensionally movable unit. Therefore, even when scales generated and came off from the heated portion of the workpiece 1 should get into the three-dimensionally movable unit, the lubricant can prevent the generation of seizure defects on the surface of rolls in the three-dimensionally movable unit.

In the three-dimensionally bending machine according to the present invention, since a cooling fluid is supplied to the three-dimensionally movable unit 4 to cool down the three-dimensionally movable unit 4, it is possible to prevent the decrease of the strength of the three-dimensionally movable unit 4, the deterioration of the machining accuracy of the three-dimensionally movable unit due to thermal expansion, and the generation of seizure defects on the surface of rolls in the three-dimensionally movable unit.

Figure 5:
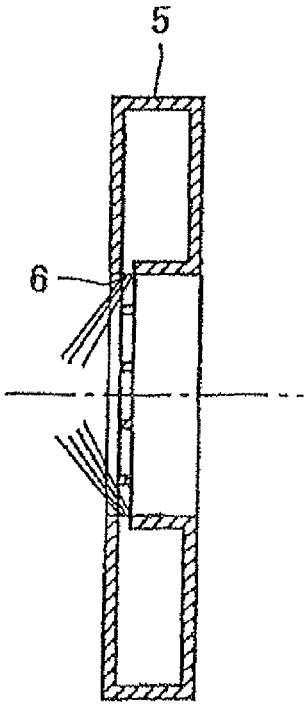
FIG. 5 is a diagram schematically illustrating an example of the structure of a heating and cooling unit provided in the three-dimensionally bending machine according to the present invention.

FIG. 5 is a diagram schematically illustrating an example of the structure of each of the heating and cooling unit provided in the three-dimensionally bending machine according to the present invention. The ring-shaped high-frequency induction heating coil 5 is provided around the outer circumference of workpiece to be heated, and heats a portion of workpiece at a temperature which is high enough to enable the heated portion to be locally plastically deformed. Then, a bending moment is applied to the heated portion by action of the three-dimensionally movable unit, and subsequently the cooling device 6 injects the cooling fluid to quench the heated portion of the workpiece. Before high frequency induction heating, the workpiece is held by the two pairs of supporting rolls. In this example embodiment, the heating and cooling units are integrated into one-piece, but the present invention is not limited thereto.

According to this bending method, it is possible to successively and continuously heat metal material as workpiece at a temperature which allows coarse grains not to be generated and is an $A_3$ transformation point or more. In addition, the locally heated portion of metal material is plastically deformed by the three-dimensionally movable unit, and then immediately the cooling fluid is injected to the deformed portion, which makes it possible to ensure a cooling rate of 100° C./sec or more.

Thus, the metal material as the workpiece subjected to bending can have excellent shape fixability and stable quality. For example, even when a workpiece having low strength is bent as a starting material, it is possible to increase the strength of the metal material by uniform quenching, and thus obtain a metal product having a tensile strength of 900 MPa or more, preferably, 1300 MPa or more.

When the workpiece is thick in wall thickness, there are some cases that it becomes difficult to ensure a cooling rate of 100° C./sec or more. In this regard, when the workpiece is a round tube, a rectangular tube, or a trapezoidal tube with a closed cross section (metal tube), a mandrel as a cooling means can be inserted into the workpiece having the closed cross section.

Figure 6:
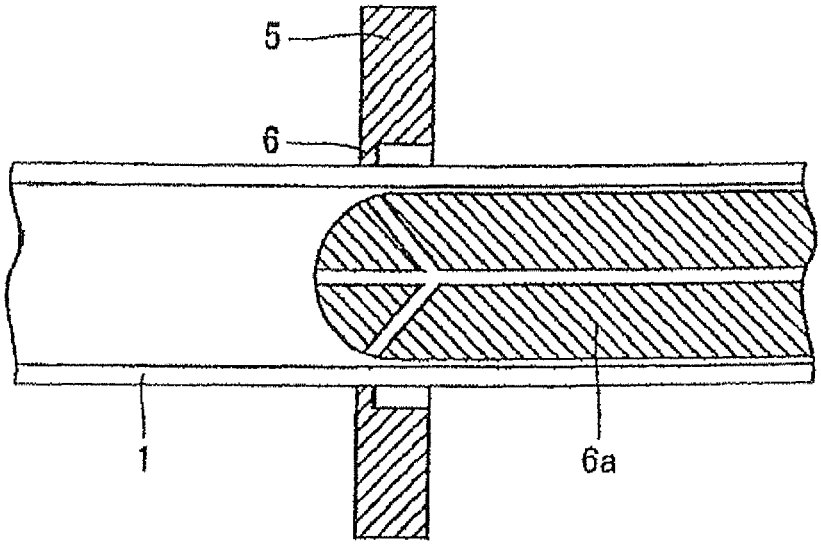
FIG. 6 is a diagram illustrating the structure of a mandrel that is inserted into a metal material as a workpiece having a closed cross section (a metal tube) in order to ensure the cooling rate even for a heavy-wall workpiece.

FIG. 6 is a diagram illustrating the structure of the mandrel that is inserted into the workpiece having the closed cross section (metal tube) in order to ensure the cooling rate of the heavy-wall workpiece. When the workpiece with the closed cross section is thick in wall thickness, a mandrel 6*a* can be inserted into the workpiece as a cooling means. It is possible to ensure the cooling rate by supplying a cooling medium into the mandrel 6*a* in synchronization with the cooling device 6 provided around the outer circumference of workpiece 1. In this case, a fluid or mist may be supplied into the workpiece 1 to cool down the workpiece 1, and the mandrel 6*a* is desirably made of a non-magnetic material or a refractory material.

In the three-dimensionally bending machine according to the present invention, the cooling medium supplied from the cooling device 6 desirably includes water as a primary component and a rust-preventative agent. When a sliding contact section of the three-dimensionally bending machine is wet by cooling water containing no rust-preventative agent, rust occurs, which may cause serious machine malfunctions. Therefore, it is effective that the rust-preventative agent be contained in the cooling water in order to protect the machine.

Further, it is desirable that the cooling medium supplied from the cooling unit contains water as a primary component, and a quenching agent. For example, a quenching agent mixed with an organic polymer agent has been known. When the quenching agent having a predetermined concentration is mixed with water, it is possible to adjust the cooling rate and thus ensure a stable quenching performance.

3. Structure of Three-Dimensionally Movable Unit

Figure 7:
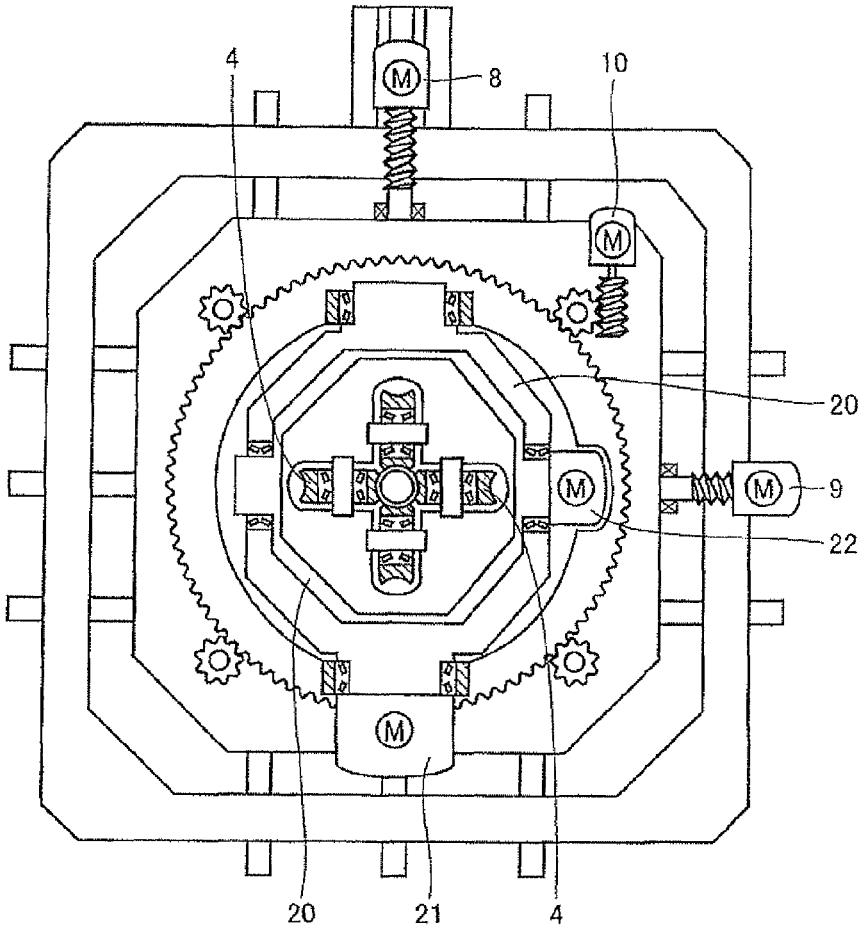
FIGS. 7(*a*) and 7(*b*) are diagrams illustrating a shifting mechanism for movement in the vertical and horizontal directions, a rotating mechanism for rotation in a circumferential direction of a three-dimensionally movable unit (comprising rolls as roller-dies) and a tilting mechanism for vertically and horizontally inclining movements all of which are provided in the three-dimensionally bending machine according to the present invention.
Figure 7:
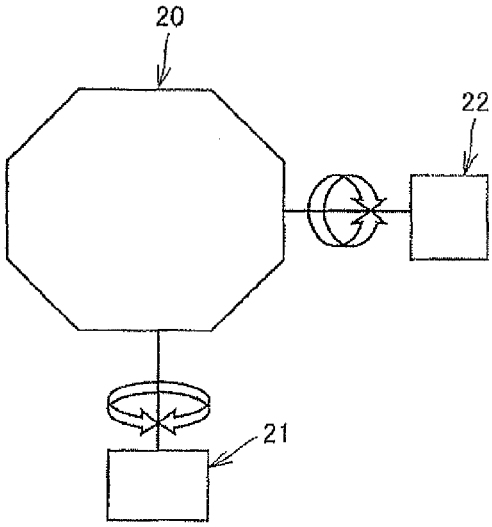

FIG. 7(*a*) is a diagram illustrating the structural examples of shifting mechanisms in the three-dimensionally movable unit for moving itself in a vertical and horizontal directions and a rotating mechanism for rotating the same in a circumferential direction, which is employed in the three-dimensionally bending machine according to the present invention. The workpiece (round tube) 1, which is a metal material such as an alloy, is supported by the three-dimensionally movable unit 4 having four rolls. The shifting mechanism for moving the three-dimensionally movable unit in a vertical direction is operated by a driving motor 8, and the shifting mechanism for moving the same in a horizontal direction is operated by a driving motor 9. The rotating mechanism for rotating the three-dimensionally movable unit in a circumferential direction is operated by a driving motor 10. Further, the three-dimensionally movable unit 4 includes a tilting mechanism for inclining itself in both horizontal and vertical planes.

FIG. 7(*b*) shows an outline structure of the tilting mechanism for inclining the three-dimensionally movable unit 4 in both horizontal and vertical planes. The tilting mechanism to be used in the present invention is not limited to a specific structure, but any tilt mechanism in common use may be used. For example, the tilting mechanism for the horizontal inclining may be operated by a driving motor 21, and the tilting mechanism for the vertical inclining may be operated by a driving motor 22.

Figure 8:
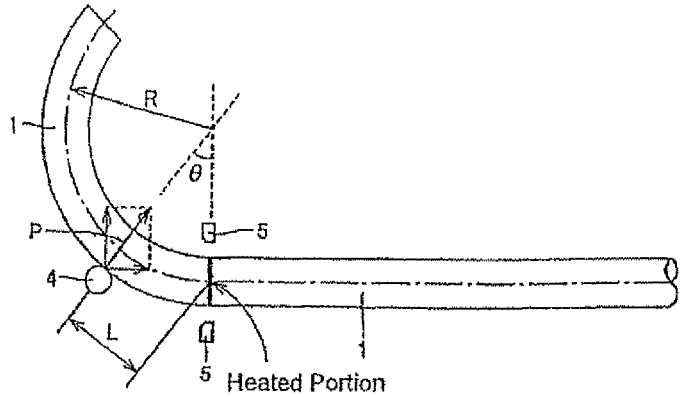
FIG. 8 is a diagram illustrating the operation of a moving mechanism for movement in the forward or backward direction of the three-dimensionally movable unit that is provided in the three-dimensionally bending machine according to the present invention.

FIG. 8 is a diagram illustrating the operation of a moving mechanism for moving the three-dimensionally movable unit provided in the three-dimensionally bending machine according to the present invention in the forward or backward direction. As shown in FIG. 8, when the length of an arm (processed length of the workpiece) is L, a bending moment M required for bending is represented by Expression A given below:

$$M=P\times L=P\times R\cdot\sin\theta \qquad \text{[Expression A]}$$

Therefore, as the length L of the arm increases, force P exerted on pinch rolls (rolls as roller-dies in the three-dimensionally movable unit) 4 becomes smaller. That is, in view of the processing range from a small bending radius to a large bending radius, when the three-dimensionally movable unit 4 cannot be moved in the forward or backward direction, the force P, required to process the workpiece 1 so as to have a small bending radius, restricts the bending equipment. Therefore, when the length L of the arm is set to be large so as to process the workpiece 1 to have a small bending radius, the shifting mechanisms and the tilting mechanism of the three-dimensionally movable unit require a large stroke for processing workpiece to have a large bending radius, which results in an increase in the scale of the three-dimensionally bending machine.

Meanwhile, considering an instantaneous stopping accuracy or allowable play (movement runout) of the three-dimensionally bending machine, when the length L of the arm is small, the processing accuracy is lowered. Therefore, it is possible to select the optimum length L of the arm by moving the three-dimensionally movable unit 4 in the forward or backward direction according to the bending radius of the workpiece 1, and thus to widen the available processing range. In this case, it is also possible to ensure sufficient processing accuracy without increasing the scale of the three-dimensionally bending machine.

Furthermore, in the three-dimensionally bending machine according to the present invention, the high-frequency induction heating and cooling unit can have, independently or integrally, a moving mechanism for moving itself in the forward or backward direction. This structure makes it possible to ensure synchronizing with the three-dimensionally movable unit and to heat the leading end of workpiece at the beginning of bending. As a result, it is possible to improve workability and operability when the metal tube is mounted or demounted.

Figure 9:
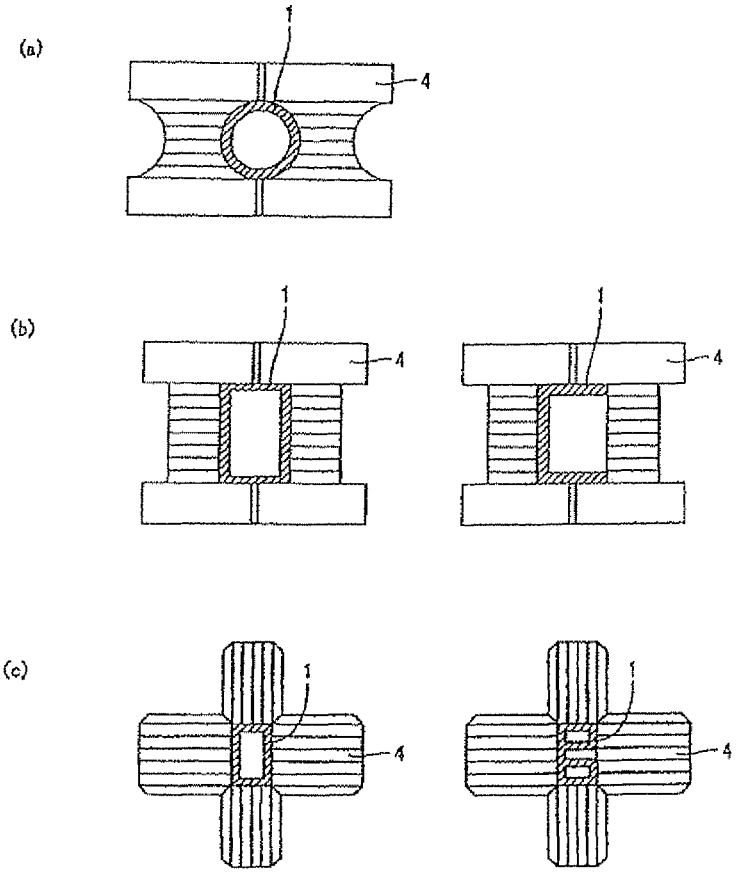
FIGS. 9(*a*) to 9(*c*) are diagrams illustrating example configurations of the three-dimensionally movable unit that is provided in the three-dimensionally bending machine according to the present invention. Specifically, FIG. 9(*a*) shows the three-dimensionally movable unit having two rolls as roller-dies when a workpiece is a member with a closed cross section, such as a round tube, FIG. 9(*b*) shows the three-dimensionally movable unit having two rolls when a workpiece is a member with a closed cross section, such as a rectangular tube, or a member with an open cross section, such as a channel, and FIG. 9(*c*) shows the three-dimensionally movable unit having four rolls when a workpiece is a member with a closed cross section, such as a rectangular tube, or a member with an irregular cross section, such as a channel.

FIGS. 9(*a*) to 9(*c*) are diagrams illustrating examples of the configuration of the three-dimensionally movable unit provided in the three-dimensionally bending machine of the present invention. Specifically, FIG. 9(*a*) shows a three-dimensionally movable unit including two rolls as roller-dies when a workpiece is a member with a closed cross section such as a round tube, FIG. 9(*b*) shows a three-dimensionally movable unit including two rolls when a workpiece is a member with a closed cross section such as a rectangular tube, such as a channel, and FIG. 9(*c*) shows a three-dimensionally movable unit including four rolls when a workpiece is a member with a closed cross section such as a rectangular tube or a member with an irregular cross section, such as a channel.

The roll caliber type of the three-dimensionally movable unit 4 can be designed according to the cross section of the workpiece 1. The number of rolls is not limited to 2 or 4, as shown in FIGS. 9(*a*) to 9(*c*), but the three-dimensionally movable unit may include three rolls. In general, the workpiece is made by the metal material used for bending can have a closed cross section with a circular shape, a rectangular shape, a trapezoidal shape, or a complex shape, an open cross section formed by a roll forming operation, or an irregular cross section formed by an extrusion operation. However, when the workpiece 1 has a substantially rectangular cross section, as shown in FIG. 9(*c*), it is desirable that the three-dimensionally movable unit includes four rolls.

In the three-dimensionally bending machine according to the present invention, as shown in FIG. 7, a rotating mechanism for rotating in a circumferential direction can be provided in the three-dimensionally movable unit 4 in order to twist the workpiece At the same time, although not shown in FIG. 1, the feeding unit 3 can be provided with a chucking mechanism 7 capable of holding and rotating the workpiece 1 in a circumferential direction, which serves as a rotating mechanism.

Therefore, in order to twist the workpiece in the three-dimensionally bending machine according to the present invention, the following methods can be used a method of twisting the leading end of the workpiece using the rotating mechanism of the three-dimensionally movable unit; and a method for twisting the rear end of the workpiece using the rotating mechanism of the feeding unit. In general, when the method of twisting the rear end of the workpiece using the rotating mechanism of the feeding unit is employed, a compact machine structure is obtained. On the other hand, in the method of twisting the leading end of the workpiece using the rotating mechanism of the three-dimensionally movable unit, as shown in FIG. 7, there is an issue that the scale of the three-dimensionally bending machine will become large. However, both the methods can be used to twist the workpiece.

In the three-dimensionally bending machine according to the present invention, a rotating mechanism for rotating in a circumferential direction may be provided in the supporting unit (the supporting rolls or the supporting guide), which makes it possible to rotate workpiece in a circumferential direction in synchronization with the rotation of the feeding unit. Either the method of twisting the leading end of the workpiece using the rotating mechanism of the three-dimensionally movable unit or the method of twisting the rear end of workpiece using the rotating mechanism of the feeding unit can be used to accurately twist the workpiece in synchronization with the supporting unit.

In the three-dimensionally bending machine according to the present invention, a rolls driving and rotating mechanism may be provided in the three-dimensionally movable unit. In this case, the roll can be driven to revolve by, for example, a driving motor according to the feed amount of the workpiece fed by the feeding unit. That is, when a compressive stress exerted on a bent portion is reduced and the revolving speed of the rolls of the three-dimensionally movable unit is controlled so as to be synchronized with the feed amount of the workpiece fed by the feeding unit, it is possible to apply tensile stress to the bent portion, and the available bending range can be widened. In addition, it is possible to improve the bending accuracy of the metal product.

4. Preheating Unit and Operation Thereof

The three-dimensionally bending machine according to the present invention includes a preheating unit at the upstream side of the heating unit. The preheating unit can perform preferential heating or otherwise, two- or more-stage heating, i.e., plural-stage heating on workpiece. When the preheating unit performs plural-stage heating, it is possible to disperse heating load on the workpiece, and thus improve bending efficiency.

Figure 10:
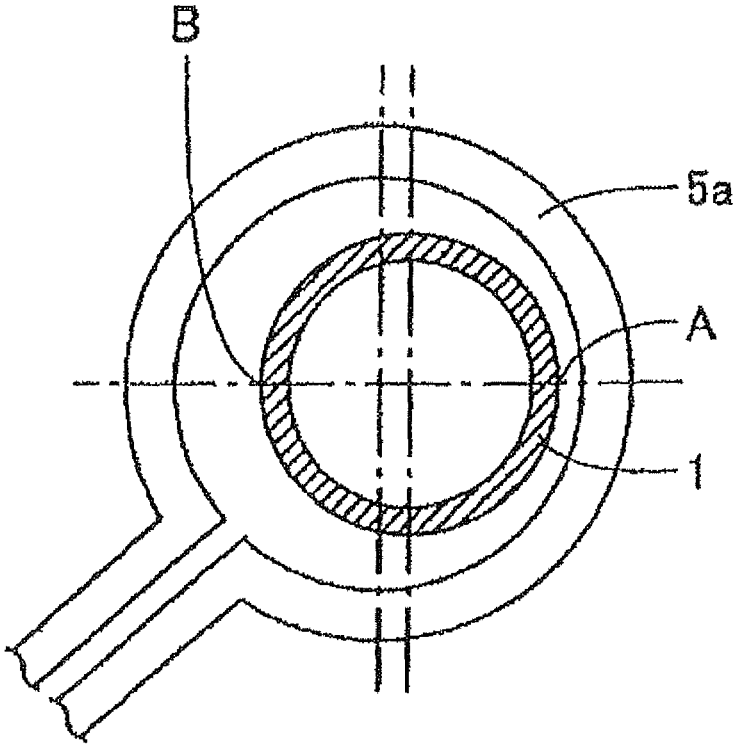
FIG. 10 is a diagram illustrating the operation of a preheating unit for performing preferential heating on a workpiece.

FIG. 10 is a diagram illustrating the operation of the preheating unit that performs preferential heating on the workpiece. When the high-frequency induction preheating coil 5*a* is used as the preheating unit to perform preferential heating on the workpiece 1, the workpiece 1 is disposed while being off-set relative to the centerline axis of the high-frequency induction preheating coil 5*a* in consideration of an orientation to which the workpiece is bent by the three-dimensionally movable unit. Thus, the heating temperature of the portion of the workpiece 1 intended to be the inner radius side of the bend can be controlled to be lower than that of the outer radius side of the bend.

Specifically, in FIG. 10, the workpiece 1 is disposed such that a portion A is close to the high-frequency induction preheating coil 5*a*, so that the temperature of the outer surface of portion A corresponding to the outer radius side of the bent portion is higher than the temperature of the outer surface of portion B corresponding to the inner radius side of the bent portion. Such configuration of the heated portion of the workpiece 1 can effectively prevent the wrinkles on the inner radius side of the bent portion and cracking on the outer radius side of the bent portion from being generated.

In the three-dimensionally bending machine according to the present invention, a lubricant can be supplied to the three-dimensionally movable unit. Therefore, even when scales generated from the heated portion of the workpiece are got into rolls in the three-dimensionally movable unit, the lubricant can retard the generation of seizure defects on the surface thereof.

Similarly, in the three-dimensionally bending machine according to the present invention, a cooling fluid can be supplied to the three-dimensionally movable unit. A cooling device for the movable unit is provided in the three-dimensionally movable unit in the vicinity of a position where the workpiece is clamped, and the cooling fluid is supplied to the three-dimensionally movable unit through the cooling device. In this way, the three-dimensionally movable unit is cooled down by the cooling fluid. As a result, it is possible to prevent the decrease of the strength of the three-dimensionally movable unit, the lowering of bending accuracy due to thermal expansion of the three-dimensionally movable unit, and seizure defects on the surface of rolls in the three-dimensionally movable unit.

5. Structure and Arrangement of Articulated Robot

Figure 11:
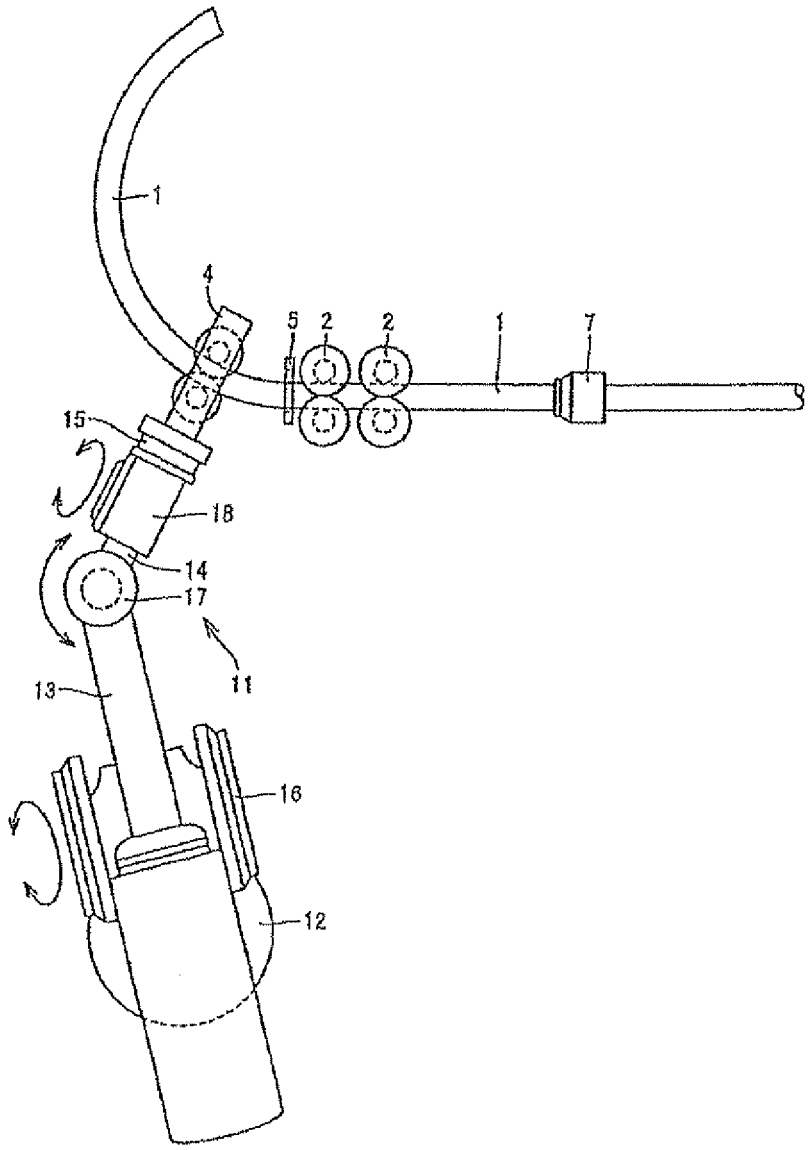
FIG. 11 is a diagram illustrating the overall structure and arrangement of an articulated robot that can be applied to the three-dimensionally bending machine according to the present invention.

FIG. 11 is a diagram illustrating the overall structure and arrangement of an articulated robot that is applicable to the three-dimensionally bending machine according to the present invention. As shown in FIG. 11, an articulated robot 11 for the three-dimensionally movable unit 4 can be provided at the downstream side of the three-dimensionally bending machine.

The articulated robot 11 for the three-dimensionally movable unit includes a fixed surface 12 that is fixed to an operating surface, three arms 13, 14, and 15, and three joints 16, 17, and 18 that connect the arms 13, 14, and 15, respectively, and each of these can rotate about its axis. The three-dimensionally movable unit 4 is attached to the leading arm 15 of the articulated robot 11.

Figure 12:
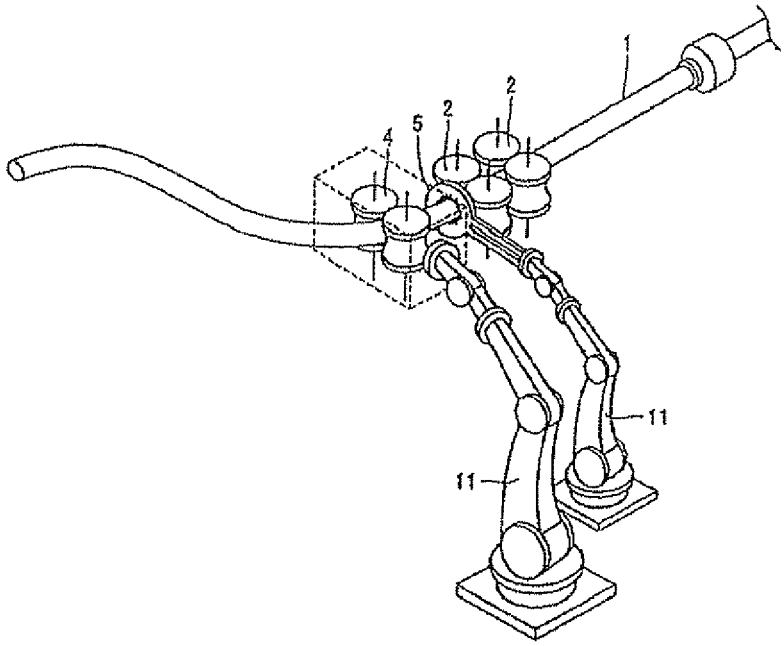
FIG. 12 is a diagram illustrating another structural example of the articulated robot that can be applied to the three-dimensionally bending machine according to the present invention.

FIG. 12 is a diagram illustrating another example of the structure of the articulated robot that is applicable to the three-dimensionally bending machine according to the present invention. In the three-dimensionally bending machine shown in FIG. 11, only the articulated robot for the three-dimensionally movable unit is provided. However, both an articulated robot 11 for use in a heating and cooling unit, and the one for use in the three-dimensionally movable unit can be concurrently provided. The use of the two articulated robots makes it possible to further improve bending efficiency.

In the three-dimensionally bending machine according to the present invention, at least one articulated robot having three joints each of which can rotate about its axis is provided, so that, during bending workpiece, the articulated robots can perform, on the basis of control signals, a series of operations such as forward and backward movement, swirling or rotational motion, and concurrent motion, effected by the shifting mechanism, the tilting mechanism, and the moving mechanism of the three-dimensionally movable unit 4. That is, during the bending of the workpiece, the articulated robots can perform a total of six types of operations effected by manipulators, on the basis of the control signals. As a result, it is possible to improve bending efficiency and reduce the scale of a three-dimensionally bending machine.

6. Bending-Equipment Line

As described above, a workpiece with a closed cross section having a circular shape or the like or an open cross section is used for the three-dimensionally bending machine according to the present invention. An electric resistance welded steel tube has been generally used as materials with a circular closed cross section, round tubes, and a steel material made by roll forming has been generally used as materials with the open cross section.

Figure 13:
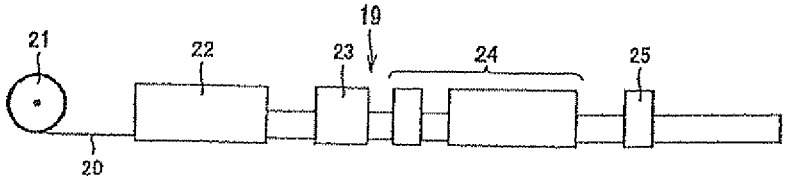
FIG. 13 is a diagram illustrating the overall structure of an electric resistance welded steel tube production line that can be used to produce a workpiece.

FIG. 13 is a diagram illustrating the overall structure of an electric resistance welded steel tube production line that is used to produce a workpiece. An electric resistance welded steel tube production line 19 is used to produce steel tubes from a strip-shaped steel sheet 20. The electric resistance welded steel tube production line 19 includes an uncoiler 21 for continuously unrolling into the strip-shaped steel sheet 20 from a strip-shaped steel sheet coil roll, a forming means 22 having a plurality of roll forming devices that form the unrolled strip-shaped steel sheet 20 into tubular product having a predetermined cross-sectional shape, a welding means 23 having a welding machine that welds the opposite side edges of the strip-shaped steel sheet to form continuous steel tubular product, a weld bead cutter, a post-annealing apparatus, a post-processing apparatus 24 that adjusts the size of the continuous product to a predetermined dimension, and a cutting apparatus 25 having a flying cutter for cutting the product of the predetermined dimension to a specific length, which are sequentially arranged in the order as above.

Figure 14:
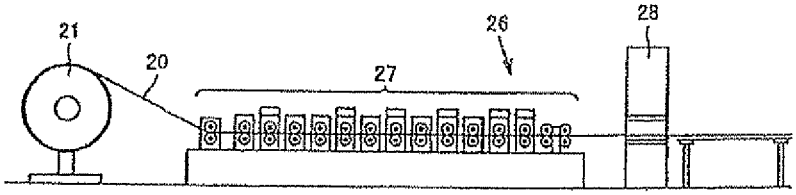
FIG. 14 is a diagram illustrating the overall structure of a roll forming line that can be used to produce a workpiece.

FIG. 14 is a diagram illustrating the overall structure of a roll forming line used to produce a workpiece. A roll forming line 26 is used to form the strip-shaped steel sheet 20 into a predetermined shape. The roll forming line 26 includes the uncoiler 21 that the strip-shaped steel sheet 20 as a blank is unwound and unrolled from the coil, a forming apparatus 27 having roll forming devices that form the strip-shaped steel sheet 20 unrolled by the uncoiler 21 into a continuous shape blank of a predetermined shape, and a cutting apparatus 28 having a flying cutter that continuously cuts the formed blank of a predetermined shape made by roll forming from the strip-shaped steel sheet 20 to a specific length.

A workpiece produced by the electric resistance welded steel tube production line 19 shown in FIG. 13 or the roll forming line 26 shown in FIG. 14 is supplied to a bending machine as a metal material to be bent. When the production lines and the bending machine are separated from each other, it is necessary to ensure a place for stocking workpiece since the processing speeds between the production line and the bending machine are different from each other. In addition, an auxiliary transfer equipment and means for transporting workpieces between the production line and the bending machine, such as a crane and a truck, are needed.

The three-dimensionally bending machine according to the present invention is sequentially provided at the exit side of the electric resistance welded steel tube production line 19 or the roll forming line 26. Therefore, an overall equipment line from that for supplying workpieces through the bending machine becomes compact, while allowing their operation conditions to be properly adjusted, whereby it becomes possible to effectively perform a bending operation to produce accurate and inexpensive bent products.

INDUSTRIAL APPLICABILITY

According to a bending machine, and a bending-equipment line according to the present invention, even when there is a need for bending a workpiece in various shapes, such as the case that the workpiece is three-dimensionally bent in different directions in a three-dimensional continuous bending operation, and even when there is a need for bending a workpiece having high strength, the workpiece is uniformly cooled down. Therefore, it is possible to effectively obtain the product having excellent shape fixability despite having high strength, and uniform hardness distribution at a low cost.

Further, since the three-dimensionally movable unit clamps workpiece, it is possible to retard the generation of seizure defects on the surface of the three-dimensionally movable unit. Therefore, the accuracy of a bending operation can be ensured, and a bending operation can be performed with a high degree of operation efficiency.

The invention claimed is:

1. A three-dimensionally bending machine comprising;

a feeding unit for successively or continuously feeding a workpiece from an upstream side of the workpiece;

a supporting unit for supporting the workpiece;

a heating and cooling unit that is provided around the outer circumference of a portion of workpiece and is provided at a downstream side of said supporting unit, both for use in heating a portion of workpiece in a temperature range which allows the heated portion to be locally plastically deformed and which allows quenching to be performed, and for use in subsequently rapidly cooling down the heated portion after a bending moment is applied thereto; and a three-dimensionally movable unit that is provided at the downstream side of said heating and cooling unit, the three-dimensionally movable unit including a set of roller-dies that are movable in a three dimensional direction, the set of roller-dies comprising two rolls, three rolls, or four rolls as roller-dies, the roller dies configured to clamp the workpiece in a clamping position, and to control the clamping position and the moving speed of the workpiece so that the roller-dies can apply the bending moment in association with a feed amount of the workpiece by said feeding unit while controlling a heating amount and a cooling amount of the workpiece by said heating and cooling unit.

2. The three-dimensionally bending machine according to claim 1, wherein the three-dimensionally movable unit includes at least one of a shifting mechanism for moving itself in a vertical direction, a shifting mechanism for moving itself in a horizontal direction, a tilting mechanism for inclining itself in a vertical plane, and a tilting mechanism for inclining itself in a horizontal plane.

3. The three-dimensionally bending machine according to claim 2, wherein the three-dimensionally movable unit further includes a moving mechanism for moving itself in the forward or backward direction relative to the workpiece.

4. The three-dimensionally bending machine according to claim 1, wherein the heating and cooling unit include at least one of a shifting mechanism for moving itself in a vertical direction, a shifting mechanism for moving itself in a horizontal direction, a tilting mechanism for inclining itself in a vertical plane, and a tilting mechanism for inclining itself in a horizontal plane.

5. The three-dimensionally bending machine according to claim 4, wherein the heating and cooling unit further include a moving mechanism for moving itself in the forward or backward direction relative to the workpiece.

6. The three-dimensionally bending machine according to claim 1, wherein the three-dimensionally movable unit includes a rotating mechanism for rotating itself in a circumferential direction.

7. The three-dimensionally bending machine according to claim 1, wherein the feeding unit includes a mechanism that holds and rotates a workpiece in a circumferential direction.

8. The three-dimensionally bending machine according to claim 7, wherein the supporting unit includes a rotating mechanism that rotates itself in a circumferential direction.

9. The three-dimensionally bending machine according to claim 1, wherein the three-dimensionally movable unit includes a driving mechanism that drives and rotates rolls as roller-dies according to the feed amount of the workpiece by the feeding unit.

10. The three-dimensionally bending machine according to claim 1, wherein the workpiece subjected to bending is a closed cross-section member, an open cross-section member, an irregular cross-section member, or a rod-shaped member that has any of various shapes in a sectional view.

11. The three-dimensionally bending machine according to claim 1, further comprising:

a preheating unit that is provided at the upstream side of the heating and cooling unit to perform plural-stage heating or preferential heating on the workpiece.

12. The three-dimensionally bending machine according to claim 1, wherein a mandrel, serving as the cooling means, is inserted into the workpiece, and a cooling medium is supplied into the mandrel.

13. The three-dimensionally bending machine according to claim 1, further comprising:

an articulated robot that has one or more joints each of which can rotate about its axis, and performs the operation of at least one of the shifting mechanism, the tilting mechanism, and the moving mechanism for the three-dimensionally movable unit, and the heating and cooling unit.

14. A three-dimensional-bending-equipment line comprising:

an electric resistance welded steel tube production line that includes: an uncoiler that continuously unrolls into a strip-shaped steel sheet; a forming means that forms the unrolled strip-shaped steel sheet into steel tubular blank having a predetermined shape in a sectional view; a welding machine that welds opposite side edges of the strip-shaped steel sheet to form continuous tubular product; and a post-processing machine that performs a weld bead cutting operation, and, if necessary, a post-annealing operation or a sizing operation; and the three-dimensionally bending machine according to claim 1 that is sequentially arranged at the exit side of said electric resistance welded steel tube production line.

15. A three-dimensional-bending-equipment line comprising:

a roll forming line that includes: an uncoiler that continuously unrolls into a strip-shaped steel sheet; and a forming means that forms the unrolled strip-shaped steel sheet into a continuous shape blank of a predetermined shape in a sectional view; and the three-dimensionally bending machine according to claim 1 that is sequentially arranged at the exit side of said roll forming line.

* * * * *